US006067439A

United States Patent [19]

Kadokura et al.

[11] Patent Number: 6,067,439

[45] Date of Patent: May 23, 2000

[54] DELIVERY MEMBER, AND APPARATUS EMPLOYING THE SAME

[75] Inventors: Susumu Kadokura, Sagamihara; Naoki Shirai, Ibaraki-ken; Shigeru Yoshimura, Yokohama; Tomoaki Kato, Sagamihara; Yoshiaki Tomari, Yokohama; Tadanori Suto, Tokyo, all of Japan

[73] Assignee: Canon Kabushiki Kaisha, Tokyo, Japan

[21] Appl. No.: 07/985,253

[22] Filed: Dec. 3, 1992

[30] Foreign Application Priority Data

Dec. 4, 1991 [JP] Japan ..... 3-320543

[51] Int. Cl.[7] ..... G03G 15/00

[52] U.S. Cl. ..... 399/388; 399/397; 399/400

[58] Field of Search ..... 355/208, 245, 355/308; 29/309; 428/367, 558; 430/347, 11

[56] References Cited

U.S. PATENT DOCUMENTS

| | | | |
|---|---|---|---|
| 4,017,435 | 4/1977 | Kondo et al. | 260/22 A |
| 4,303,733 | 12/1981 | Bülle et al. | 428/367 |
| 4,333,807 | 6/1982 | Suzuki et al. | 204/181 T |
| 4,541,711 | 9/1985 | Takahashi | 355/309 X |
| 4,888,244 | 12/1989 | Masubuchi et al. | 428/416 |
| 4,898,849 | 2/1990 | Kang | 503/214 |
| 5,011,655 | 4/1991 | Mankins | 419/8 |
| 5,023,146 | 6/1991 | Saito et al. | 428/623 |
| 5,169,704 | 12/1992 | Faust | 428/143 |
| 5,215,841 | 6/1993 | Scharfe et al. | 430/59 |

FOREIGN PATENT DOCUMENTS

| | | |
|---|---|---|
| 0401886 | 12/1990 | European Pat. Off. . |
| 0452880 | 10/1991 | European Pat. Off. . |
| 55-011175 | 1/1980 | Japan . |
| 59-051958 | 3/1984 | Japan . |
| 60-007716 | 2/1985 | Japan . |

*Primary Examiner*—William Royer
*Attorney, Agent, or Firm*—Fitzpatrick, Cella, Harper & Scinto

[57] ABSTRACT

A delivery member has a substrate material, a first coating film containing a filler and formed by electrodeposition on a substrate material, and a second coating film composed of an organic coating film formed on the first coating film.

13 Claims, 5 Drawing Sheets

DELIVERY MEMBER, AND APPARATUS EMPLOYING THE SAME

BACKGROUND OF THE INVENTION

1. Field of the Invention

The present invention relates to a delivery member useful for OA instruments, printers, and the like. The present invention also relates to an apparatus employing the delivery member.

2. Related Background Art

An apparatus such as an electrophotographic apparatus, a printer, and a facsimile machine comprises a delivery path for delivering an image-receiving medium like a recording paper sheet and a plastic sheet. The delivery path comprises a delivery member in a shape of a roller, a plate, a belt or the like.

In delivering the image-receiving medium, the delivery member is brought into contact with the image-receiving medium. Therefore the delivery member is required to be durable. Further, in high-speed recording and color recording, since the image-receiving medium needs to be delivered accurately, the surface of the delivery member is required to be uniform.

Conventional delivery members have a surface formed by one of the methods described below:

(a) a steel material is coated by spray coating with a coating liquid which contains a filler such as metal fine particles,
(b) a steel material is plated with a metal, and has coated thereon with rubber, and is further coated with Teflon (registered trade name),
(c) a steel material is roughened at the surface by sand blasting or laser machining, and then is plated with a metal,
(d) a steel material is plated with a metal, and alumina is deposited thereon electrostatically, or
(e) a steel material is plated with a metal, and is further subjected to composite plating to form a coating containing SiC, diamond, or the like.

The surface formed as above involves problems as below.

The delivery member of the method (a) above has disadvantages both in mass productivity and in the surface properties for the material requiring high surface uniformity as the delivery member, even if it is produced in an automated production line: one coating robot is not capable of coating accurately a plurality of members simultaneously, and the surface state of the coating film tends to become nonuniform owing to diffusion of the paint.

The delivery member of the method (b) above may cause difficulty in charging and discharging of the recording medium owing to deterioration and deformation of the rubber with time and the decrease of the outside diameter accuracy during repeated use, and problems in mass productivity because of the low of the commercial value, the long production steps and low production efficiency, resulting in high production cost.

The delivery member of the method (c) above needs to be treated for rust-prevention in the subsequent step since the surface is liable to rust at the surface. In this case, the metal is plated on the sand-blasted surface having low outside diameter accuracy, resulting in further less accurate outside diameter, and the increase of the manufacturing steps causes cost increase, thus being not suitable for mass production. Further, a delivery member which is roughened at the surface by laser machining to give higher friction coefficient has to be machined one by one at a time with a long machining time, which is not suitable for mass production.

The delivery member of the method (d) above is poor in adhesion and uniformity of the alumina, and in the final outside diameter accuracy, and is limited in mass production of uniform quality of the products.

In the production of the delivery member of the method (e) above, namely composite plating, the bath is liable to be contaminated with impurity to become unstable and is not suitable for continuous use. Further, the working cost is disadvantageously high because of the cost of the plating liquid and the poor dispersibility.

SUMMARY OF THE INVENTION

The present invention intends to provide a delivery member for deliverying an image-receiving medium which is excellent in abrasion resistance and surface uniformity, and is stable in broad ranges of temperature and humidity conditions without the disadvantages of the prior art.

The present invention also intends to provide an electrophotographic apparatus employing the delivery member, and a facsimile machine employing the electrophotographic apparatus.

The present invention further intends to provide an ink-jet recording apparatus employing the delivery member.

The delivery member according to the present invention comprises a first coating film containing a filler and formed by electrodeposition on a substrate material, and a second coating film composed of an organic coating film formed on the first coating film.

The electrophotographic apparatus according to the present invention comprises a photosensitive member, an image-exposing means, a developing means for developing a latent image formed by the image-exposing means, a transferring means for transferring the developed image onto an image-receiving medium, and a delivery path for delivering the image-receiving medium, the delivery path being constructed of a delivery member which comprises a first coating film containing a filler and formed by electrodeposition on a substrate material, and a second coating film composed of an organic coating film formed on the first coating film.

The ink-jet recording apparatus according to the present invention comprises a recording head for ejecting ink onto an image-receiving medium, and a roller for delivering an image-receiving medium, the roller comprising a first coating film containing a filler and formed by electrodeposition on a substrate material, and a second coating film composed of an organic coating film formed on the first coating film.

DESCRIPTION OF THE PREFERRED EMBODIMENT

The delivery member in the present invention is used to construct the path for deliverying an image-receiving medium such as recording paper sheet and a plastic sheet in an electrophotographic apparatus, a printer, a facsimile machine, or the like, and includes all the members which are brought into contact with the image-receiving medium.

The delivery member of the present invention includes a roller, a belt, a plate-shaped guide, etc.

The delivery member of the present invention comprises, as illustrated in FIG. 1 to FIG. 4, a first coating film 1 containing a filler and formed by electrodeposition on a substrate material 4, and a second coating film 20 composed of an organic coating film formed on the first coating film. An image-receiving medium to be delivered is brought into contact with the surface of the delivery member. The first coating film 1 composed of an electrodeposited film containing a filler improves the surface of the delivery member by giving a suitable friction coefficient, a sufficient surface density and excellent abrasion resistance. The second coating film 20 composed of an organic film enables stable delivery of the image-receiving medium for a long term under environmental conditions of from high temperature to low temperature or from high humidity to low humidity.

The electrodeposited coating film signifies a coating film formed by electrodeposition in which a pair of electrodes is placed in a solution containing a coating substance dissolved therein (hereinafter referred to as an "electrodeposition paint") and DC voltage is applied between the electrodes to deposit the substance onto one of the electrodes. In preparation of the delivery member of the present invention, the substrate material is used as the one of the electrodes, and another material such as a stainless steel plate is used as the other electrode.

The substance for the substrate material 4 includes metals such as aluminum, aluminum alloy, stainless steel, and iron; and heat-resistant plastics such as polycarbonate, ABS, CF/ABS, modified PPE, modified PPO, and GF/PC. If the substrate material 4 is nonmetallic, the substrate material 4 needs to be carried out subbing treatment for giving electroconductivity prior to the electrodeposition. Other subbing treatment may be applied prior to the electrodeposition if necessary depending on the properties of the substrate material 4.

Figure 1:
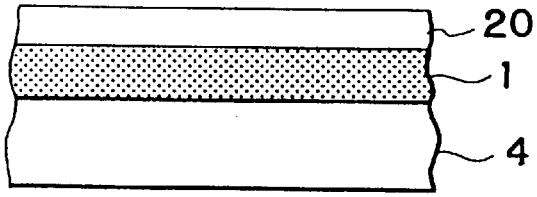
FIG. 1 is a partial sectional view of a delivery member of the present invention.

The delivery material shown in FIG. 1 is constituted of a substrate material 4 made of a metal such as aluminum, a first coating film 1 formed thereon by direct electrodeposition, and a second coating film 20 made of an organic material formed thereon.

Figure 2:
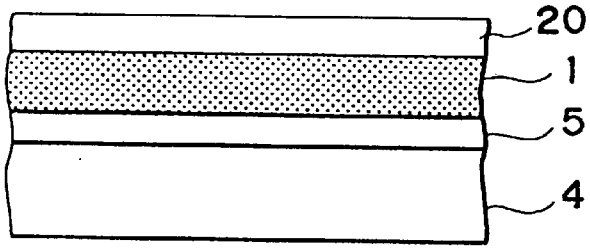
FIG. 2 is a partial sectional view of another delivery member of the present invention.

The delivery material shown in FIG. 2 is composed of a substrate material 4 made of a metal such as aluminum, an anodic oxide subbing layer 5 for improving adhesiveness on the substrate material, the first coating film 1 and the second coating film 20 formed thereon.

Figure 3:
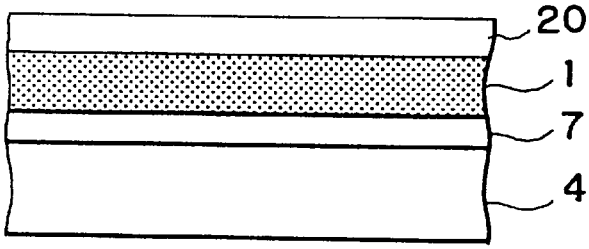
FIG. 3 is a partial sectional view of a still another delivery member of the present invention.

The delivery material shown in FIG. 3 is composed of a substrate material 4 made of a metal such as iron, a subbing layer 7 formed by chemical conversion for rust prevention on the substrate material, and the first coating film 1 and the second coating film 20 formed thereon.

Figure 4:
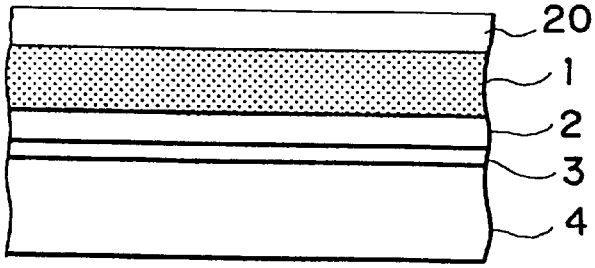
FIG. 4 is a partial sectional view of a further delivery member of the present invention.

The delivery material shown in FIG. 4 is constituted of a resin substrate material 4, on the surface of which a sub-layer with a double layer structure comprised of a catalysis-treated layer 3 and a metal-plating layer 2 have been formed, on the metal plating layer 2 of which the first coating film 1 and the second coating film 20 have been formed.

The electropaint for the first coating film 1 is prepared by incorporating a filler into an electrodepositable resin.

The resin for the electrodeposition has been comprehensively studied. The electropaint resin has to be electrically chargeable in order to be electrically deposited. On application of DC voltage, the charged resin is attracted to an anode or a cathode to deposite thereon to form a coating film. The resin employed in the present invention includes cold-setting resins such as acrylic-melamine resins, acrylic resins, epoxy resins, urethane resins, and alkid resins, which are conventionally used in electrodeposition coating. Practically water-soluble or water-dispersible resins having a carboxyl group are preferred as the electropaint resin, although the resin may be either anionic or cationic. A prepolymer having a carboxyl group is soluble or dispersible on neutralization by ammonia or an organic amine.

The electropaint employed in the present invention is preferably a solution or a dispersion of a desired resin in water, which may contain additionally an organic solvent such as an alcohol or a glycol ether. The organic solvent at a content of several percent is sufficient.

The preferred filler to be incorporated in the first coating film 1 formed electrodeposition includes powdery ceramics, powdery metals, organic or inorganic powdery materials, and powdery materials plated with a metal at the surface (hereinafter "metal-plated powdery material"). The powdery metals and metal-plated powdery materials are effective for imparting electroconductivity.

A variety of powdery ceramics are useful without special limitation, preferably including powder of ceramics such as SiC, $SiO_2$, $Si_3N_4$, TaC, ZrO, $Al_2O_3$, NbC, etc.

The powdery metal is not specially limited, and preferably includes powder of metals such as Au, Ag, Co, Cu, Fe, Mn, Ni, Pd, Sn, Te, etc. The metal is preferably pulverized by thermal plasma evaporation, or milling, or a like process.

The metal-plated powdery material includes powder of fluororesins, polyethylene resins, acrylic resins, polystyrene resins, nylon resins which are plated with Cu, Ni, Ag, Au, Sn, etc. The metal-plating of the surface of the powder is suitably practiced by electroless plating by use of nickel or copper in view of the cost.

The particle size of the filler is the range of from 0.1 to 10 $\mu$m, preferably from 0.3 to 5 $\mu$m in terms of an average particle diameter as measured by sedimentation type particle size distribution tester SACP-3 (made by Shimadzu Corporation). If the average particle diameter is extremely small, the ability for deliverying the image-receiving medium is low. On the other hand, if the average particle diameter is excessively large, the strength of the electrodeposited film is low.

The filler is contained in the electropaint at a content in the range of preferably from 5 to 50 parts by weight, more preferably from 5 to 20 parts by weight based on 100 parts by weight of the depositable resin.

The electrodeposited first coating film 1 is formed by electrodeposition by immersing the substrate material 4 as an electrode together with the other electrode in an electropaint. The electropaint is prepared preferably by dispersing the resin and the filler by means of a ball mill for 24 to 35 hours, and diluting the dispersion with desalted water to a solid content of from 10 to 15% by weight, more preferably from 7 to 15% by weight. For anion type resins, the substrate material 4 is used as an anode, while for cation type resins, the substrate material 4 is used as the cathode. In the electrodeposition, the preferred conditions are: the temperature of the electropaint of from 20 to 25° C., the hydrogen ion concentration of pH 8 to 9, the DC voltage application of from 50 to 200 V, the current density of from 0.5 to 3 $A/dm^2$, and the electrodeposition time of from 3 to 6 minutes.

After the electrodeposition, the substrate material 4 is taken out from the electropaint, washed with water, and drained. Thereafter, the electropaint coating is cured by placing the substrate material 4 in an oven at a temperature of from 95 to 140° C. for 60 to 180 minutes to finish the electrodeposited first coating film 1. The amount of the co-deposited filler in the first coating film is preferably in the range of from 5 to 50% by weight, more preferably from 20 to 40% by weight. The co-deposition of the filler is confirmed by X-ray microanalyzer, and the amount of the co-deposition is measured by thermogravimetric analysis.

In the electrodeposition by use of a electropaint containing a powdery material, the powdery material co-deposites in the formed film. This is considered to be caused by the phenomenon that the resin molecules are adsorbed on the surface of the powder particles in the electropaint, and the powder particles migrate to the electrode along with the resin molecules attracted to the electrode. The first coating film has an average thickness preferably of from 5 to 30 $\mu$m, more preferably from 7 to 15 $\mu$m, where the average thickness signifies the average of the distance between the surface of the substrate material 4 and the top of the projection caused by the filler.

The second coating film 20 is preferably formed from a curable resin exhibiting surface tackiness and having elasticity. The resin includes urethane resins, urethane-epoxy resins, urethane-acrylic resins, acrylic resins, etc. The second coating film 20 has preferably a thickness of not less than 3 $\mu$m, more preferably from 5 to 30 $\mu$m, still more preferably from 5 to 25 $\mu$m.

The second coating film 20 may be formed by spray coating, immersion coating, or electrodeposition. With the second coating film 20 of an organic nature, the delivery member of the present invention exhibits excellent deliverying ability and excellent abrasion resistance even in an environment of a low temperature and a low humidity, or of a high temperature and a high humidity.

The application examples of the delivery member according to the present invention is described by reference to FIG. 5, FIG. 6 and FIG. 7.

Figure 5:
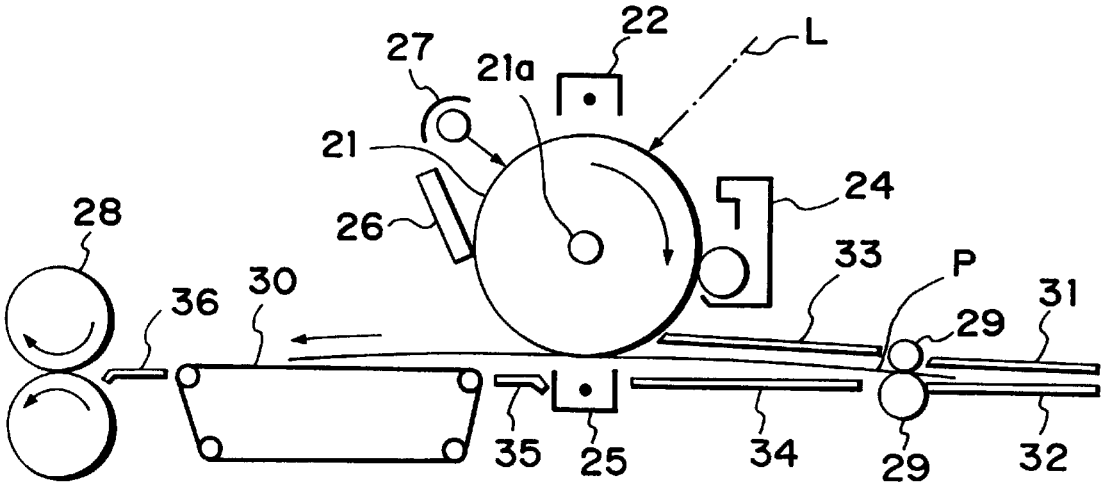
FIG. 5 illustrates schematically a side view of a transfer type of electrophotographic apparatus employing the delivery member of the present invention.

FIG. 5 illustrates schematically a constitution of a generally used transfer type electrophotographic apparatus employing a drum type photosensitive member.

In FIG. 5, a drum type photosensitive member 21 is driven to rotate around the axis 21*a* in the arrow-marked direction at a prescribed peripheral speed. During the rotation cycle, the photosensitive member 21 is charged positively or negatively at the peripheral face uniformly by an electrostatic charging means 22, and then exposed to image-exposure light L (e.g. slit exposure, laser beam-scanning exposure, etc.) at the exposure section with an image-exposure means (not shown in the drawing), whereby an electrostatic latent image is formed on the peripheral surface of the photosensitive member in accordance with the exposed image.

The electrostatic latent image is developed with a toner by a developing means 24. The toner images are transferred by a transfer means 25 onto a surface of an image-receiving medium P such as paper which is delivered to an image-transfer means 25 through a delivery path constituted by a feed section not shown in the drawing, delivery guides 31, 32, a pair of registrating delivery rollers 29, and delivery guides 33, 34.

The image-receiving medium P having received the transferred image is delivered to an image-fixing means 28 through a delivery path constructed by a delivery guide 35, delivery belt 30, and a delivery guide 36, and the image is fixed by the image-fixing means 28 to complete the image formation.

In the electrophotographic apparatus illustrated in FIG. 5, the delivery member of the present invention is useful for the delivery guides 31, 32, 33, 34, 35, and 36, the registrating delivery rollers 29, and the delivery belt 30.

After the image transfer, the surface of the photosensitive member 21 is cleaned with a cleaning means 26 to remove the remaining un-transferred toner, and is treated for charge elimination with a pre-exposure means 27 for repeated use for image formation.

In the case where the electrophotographic apparatus illustrated in FIG. 5 is used as a printer of a facsimile machine, the image exposure light L is projected in accordance with received data. FIG. 6 is a block diagram showing an example of the principle of a facsimile system.

Figure 6:
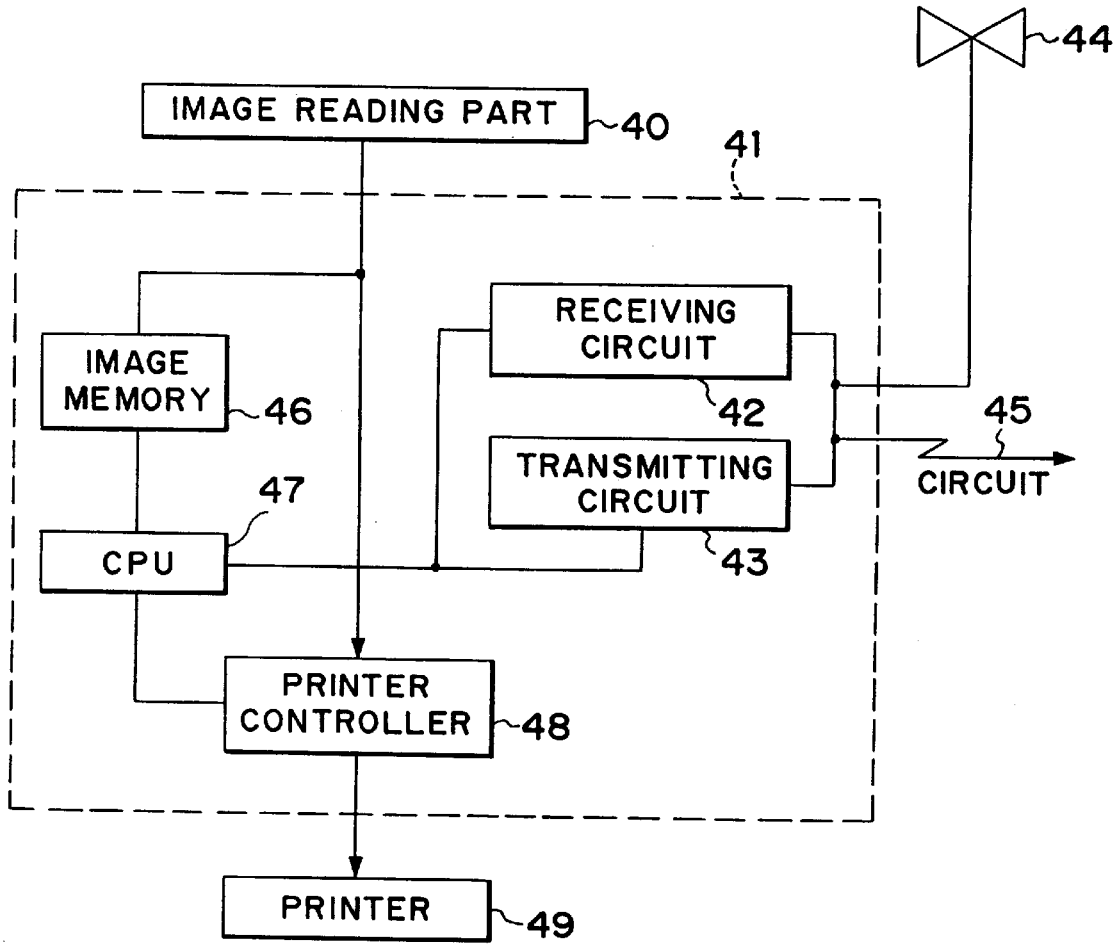
FIG. 6 is a block diagram of a facsimile system employing the electrophotographic apparatus as a printer.

In FIG. 6, a controller 41 controls the image-reading part 40 and a printer 49. The entire of the controller 41 is controlled by a CPU 47. Readout data from the image reading part 40 is transmitted through a transmitting circuit 43 to the other communication station. Data received from the other communication station is transmitted through a receiving circuit 42 to a printer 49. The image data is stored in image memory 46. A printer controller 48 controls a printer 49. The numeral 44 denotes a telephone set.

The image received through a circuit 45, namely image information from a remote terminal connected through the circuit, is demodulated by the receiving circuit 42, treated for decoding of the image information in CPU 47, and successively stored in the image memory 46. When at least one page of image information has been stored in the image memory 46, the images are recorded in such a manner that the CPU 47 reads out the one page of image information, and sends out the decoded one page of information to the printer controller 48, which controls the printer 49 on receiving the one page of information from CPU 47 to record the image information.

During recording by the printer 49, the CPU 47 receives the subsequent page of information.

Images are received and recorded in the manner as described above.

Figure 7:
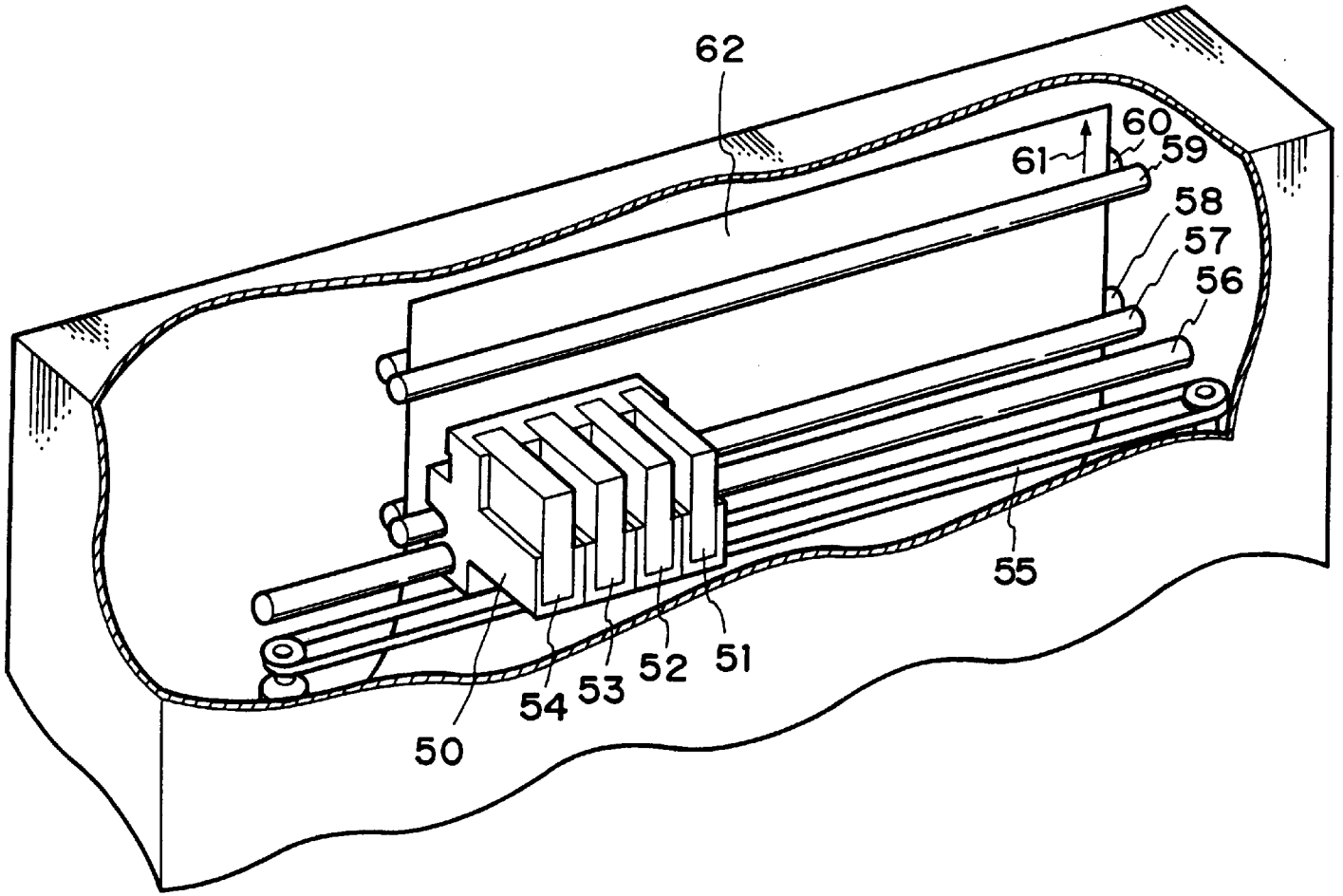
FIG. 7 shows schematically a perspective view of an ink-jet recording apparatus employing the delivery member of the present invention.

FIG. 7 illustrate s an ink-jet recording apparatus employing the delivery member of the present invention. In FIG. 7, a carriage 50 is supported by a rail 56 and slides freely and is moved in reciprocation on the rail 56 by a driving force transmitted by a belt 55. An image-receiving medium 62 is held and delivered by roller pairs 57, 58, and 59, 60. The delivery member of the present invention is useful as the rollers 57, 58, 59, and 60.

A plurality of cartridges 51, 52, 53, and 54 are fitted on the carriage 50. Each of the cartridge is constructed integrally from an ink container and a recording head for ejecting and expelling ink. The recording heads are confronted with the image-receiving medium 62 which is delivered in a direction indicated by an arrow mark 61. The plurality of the recording heads are provided in order to eject different color of inks. For example, the cartridges 51, 52, 53, and 54 eject respectively cyan ink, magenta ink, yellow ink, and black ink.

As described above, the delivery member of the present invention, which comprises a first coating film that is dense and abrasion-resistant, and a second coating film composed of organic nature, is capable of delivering a recording medium such as a paper sheet stably for a long term independently of change of temperature and humidity.

EXAMPLES

The present invention is described more specifically by reference to Examples.

Example 1

A delivery members of the present invention were subjected to durability test. The eight kinds of rollers A to H shown in Table 1 were prepared and tested. A plurality of rollers were prepared for each kind of rollers. One of the rollers of each kind is not used for the delivery test, but is subjected to measurement of the static friction coefficient. The other rollers of each kind were used as the registrating delivery rollers 29 of an electrophotographic apparatus shown in FIG. 5 for durability test. After delivery of 150,000 sheets of copying paper of A-4 size, the rollers having been used as the registrating delivery rollers 29 were subjected to measurement of the static friction coefficient.

The rollers for the durability test were prepared by forming the first coating film of 10 μm thick and the second coating film of 5 μm thick on an outside peripheral face of an aluminum tube of 30 mm diameter and 230 mm long. The electropaint for the electrodeposited first coating film was an anion type dispersion of 6 to 11 parts by weight of the filler shown in Table 1 in 100 parts by weight of an acrylic resin. The average particle diameter of the filler was 1.0 μm, respectively. In the case where the filler is a metal-plated powdery material, the metal was plated in a thickness of 0.1 μm. The electrodeposition was conducted at a temperature of from 20 to 25° C. After the electrodeposition of the first coating film, the coating film was cured in an oven at 100° C. for 60 minutes. The second coating film was formed by applying a urethane resin by spraying and curing the applied matter at 150° C. for 30 minutes.

Figure 8:
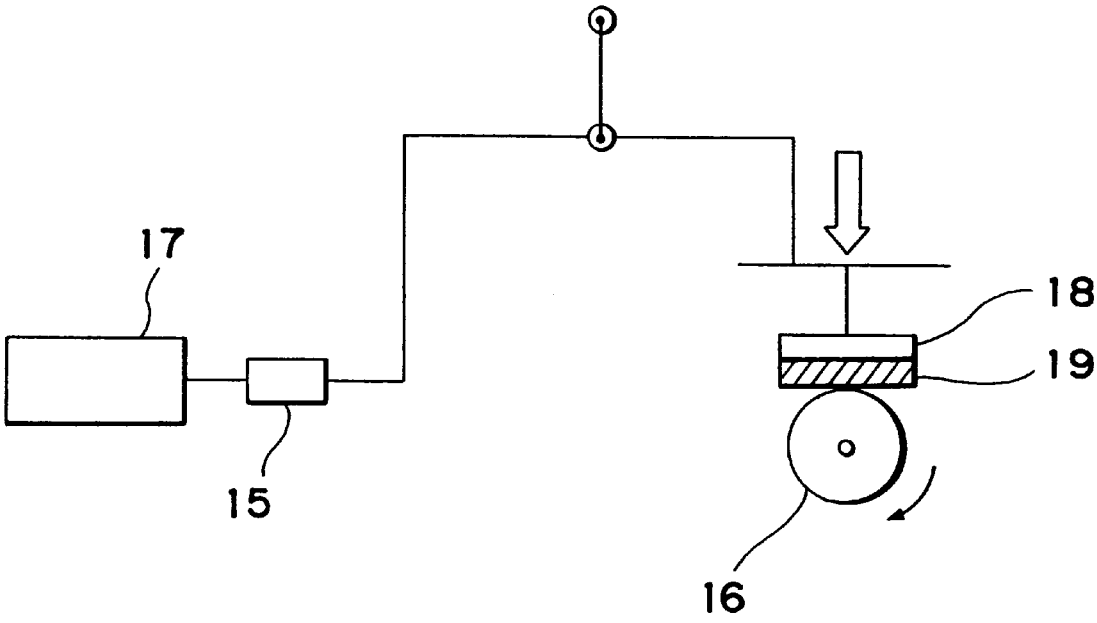
FIG. 8 shows schematically the principle of measurement of the static friction coefficient with a surface tester.

The static friction coefficient was measured by means of a surface tester shown in FIG. 8. In the test, a copying paper sheet 19 was brought into contact with the peripheral surface of the roller 16 while the roller 16 is being rotated at an angular velocity of $\omega$=1.5 rad/sec. The copying paper sheet 19 was fixed to a fixing plate 18, and a load of 1.5 kg was applied to the fixing plate in a direction of the roller 16. Thus the static friction coefficient was measured with a sensor 15 and a recorder 17.

The durability test was conducted in the conditions of a temperature of 5° C. and humidity of 10%, and of a temperature of 25° C. and a humidity of 50%. The results of the measurement are shown in Table 1.

Comparative Example 1

The durability test was conducted in the same manner as in Example 1 except that the roller used was prepared by roughening the surface of a steel tube by sand-blasting and conducting electroless nickel plating thereon. The results are shown in Table 1.

Separately, the nickel-plated surface of the steel tubes was coated with rubber, and was further coated with teflon thereon. The resulting rollers were used as the registrating delivery rollers 29 of the electrophotographic apparatus shown in FIG. 5, and the sheet delivery test was conducted with copying paper sheets of A-4 size. Consequently, the delivery became upstable after 100,000 sheets of delivery.

Example 2

An electrodeposition paint was prepared by dispersing 15 parts by weight of fine powdery alumina of average particle diameter of 1.0 μm in 100 parts by weight of an acrylic melamine resin (trade name: Honey Bright CL-1, made by Honey Chemical Co.) by means of a ball mill and then diluting with desalted water to a solid matter content of 15% by weight.

A cylindrical substrate material made of an ABS resin of 30 mm in outside diameter, 230 mm in length and 1 mm in thickness was subjected to subbing treatment. On the outside peripheral surface of this substrate material, the aforementioned electrodeposition paint was electrodeposited to form the first coating film, and thereon the second coating film of a urethane resin was formed. The resulting rollers thus prepared were used as the registrating rollers shown in FIG. 5.

The subbing of the cylindrical substrate was conducted as follows: the cylindrical substrate material made of an ABS resin was treated with a $CrO_3$—$H_2SO_4$—$H_2O$ type etching solution for one minute; the surface was catalysis-treated with palladium; electroless nickel plating was formed in a thickness of 0.5 μm; and the surface was treated with an aqueous 0.01 g/l chromic anhydride solution for one minute.

The electrodeposition was conducted by using the cylindrical substrate material as the anode and a stainless steel plate of 0.5 mm thick as the counter electrode by applying voltage of 70 V for 3 minutes at a solution temperature of 25° C. at pH 8. After the electrodeposition, the cylindrical substrate material with the formed first coating film was washed with water, and the first coating film was cured in an oven at 97±1° C. for 60 minutes. The formed electrodeposited first coating film had a thickness of 11 μm, and contained the co-deposited filler at a content of 25% by weight.

The second coating film of 5 μm thick was formed on the first coating film by spraying an urethane resin paint, and curing at 150° C. for 30 minutes.

The registrating delivery rollers thus prepared were tested for the aforementioned durability test under the conditions of temperature of 5° C. and humidity of 10%, and temperature of 25° C. and humidity of 50%. Even after delivery of 150,000 sheets of copying paper, the static friction coefficient was maintained at a satisfactory level of from 1.4 to 1.6 in comparison with the value of from 1.8 to 2.0 before the use for the delivery.

Example 3

A delivery member was prepared and evaluated in the same manner as in Example 2 except that the cylindrical substrate material was made of leaded carbon steel SLSUM and subbing-treated, and the second coating film was formed from an anion type acrylic resin electropaint.

The subbing treatment of the cylindrical substrate material was conducted by degreasing the substrate material with an alkali type degreasing agent at 60° C. for 5 minutes, washing sufficiently with water, and forming on the surface a chemical conversion coating of iron phosphate in a thickness of 3 μm.

The second coating film was electrodeposited by application of voltage of 50 V for 30 seconds, and the second coating film was cured at a temperature of 130° C. for 20 minutes.

The registrating delivery rollers thus prepared were tested for the aforementioned durability test under the conditions of temperature of 5° C. and humidity of 10%, and temperature of 25° C. and humidity of 50%. Even after delivery of 150,000 sheets of copying paper, the static friction coefficient was maintained at a satisfactory level in the range of from 1.4 to 1.7 in comparison with the value of from 1.7 to 2.0 before the use for the delivery.

Example 4

An electrodeposition paint was prepared by dispersing 8 parts by weight of alumina of average particle diameter of 1.0 μm covered thereon with electroless nickel plating of 0.1 μm thick and 8 parts by weight of powdery cobalt of average particle diameter of 0.3 μm in 100 parts by weight of an acrylic melamine resin (trade name: Honey Bright CL-1, made by Honey Chemical Co.) by means of a ball mill, and then diluting with desalted water to a solid matter content of 15% by weight.

On a cylindrical substrate material prepared in the same manner as in Example 2, a first coating film was formed from the electrodeposition paint prepared above. Further thereon, a second coating film was formed from a urethane-acrylic resin paint. The resulting rollers thus prepared were employed as the registrating delivery rollers 29 shown in FIG. 5.

The electrodeposition was conducted by using the above cylindrical substrate material as the anode and a stainless steel plate of 0.5 mm thick as the counter electrode by applying voltage of 70 V for 3 minutes at a solution temperature of 25° C. at pH 8. After the electrodeposition, the cylindrical substrate material with the formed first coating film was washed with water, and the first coating film was cured in an oven at 97±1° C. for 60 minutes. The formed electrodeposited first coating film had a thickness of 11 μm, and contained co-deposited filler at a content of 40% by weight.

The second coating film of 7 μm thick was formed on the first coating film by immersion coating of a urethane-acrylic resin paint, and curing at 140° C. for 30 minutes.

The registrating delivery rollers thus prepared were tested for the aforementioned durability test under the conditions of temperature of 5° C. and humidity of 10%, and temperature of 25° C. and humidity of 50%. Even after delivery of 150,000 sheets of copying paper, the static friction coefficient was maintained at a satisfactory level in the range of from 1.4 to 1.6 in comparison with the value of from 1.8 to 1.9 before the use for the delivery.

Example 5

An electrodeposition paint was prepared by dispersing 9 parts by weight of alumina of average particle diameter of 1.0 μm covered thereon with electroless nickel plating of 0.1 μm thick and 4 parts by weight of powdery titanium of average particle diameter of 0.3 μm in 100 parts by weight of an acrylic melamine resin (trade name: Honey Bright CL-1, made by Honey Chemical Co.) by means of a ball mill, and then diluting with desalted water to a solid matter content of 15% by weight.

On a cylindrical substrate material prepared in the same manner as in Example 3, a first coating film was formed from the electrodeposition paint prepared above. Further a second coating film was formed thereon from a urethane-acrylic resin paint. The resulting rollers thus prepared were employed as the registrating delivery rollers 29 shown in FIG. 5.

The electrodeposition was conducted by using the above cylindrical substrate material as the anode and a stainless steel plate of 0.5 mm thick as the counter electrode by applying voltage of 70 V for 3 minutes at a solution temperature of 25° C. at pH 8. After the electrodeposition, the cylindrical substrate material with the formed first coating film was washed with water, and the first coating film was cured in an oven at 120±1° C. for 50 minutes. The formed electrodeposited first coating film had a thickness of 13 μm, and contained co-deposited filler at a content of 28% by weight.

The second coating film of 5 μm thick was formed on the first coating film by spraying a urethane-acryl resin paint, and curing at 140° C. for 30 minutes.

The registrating delivery rollers thus prepared were subjected to the aforementioned durability test under the conditions of temperature of 5° C. and humidity of 10%, and temperature of 25° C. and humidity of 50%. Even after delivery of 150,000 sheets of copying paper, the static friction coefficient was maintained at a satisfactory level in the range of from 1.5 to 1.6 in comparison with the value of from 1.9 to 2.0 before the use for the delivery.

TABLE 1

| | | Static friction coefficient | | | | |
|---|---|---|---|---|---|---|
| | | Before use | | After paper sheet delivery | | Delivering ability after |
| | Filler | 5° C., 10% | 25° C., 50% | 5° C., 10% | 25° C., 50% | durability test |
| Example 1 | | | | | | |
| A | SiC | 1.9 | 2.0 | 1.6 | 1.7 | good |
| B | $Si_3N_4$ | 2.0 | 2.1 | 1.5 | 1.6 | good |
| C | TaC | 1.9 | 2.0 | 1.4 | 1.5 | good |
| D | $Al_2O_3$ | 2.0 | 2.0 | 1.4 | 1.5 | good |
| E | Ni-plated $Al_2O_3$ | 1.7 | 1.9 | 1.4 | 1.5 | good |
| F | Cu-plated $Al_2O_3$ | 1.8 | 2.0 | 1.4 | 1.5 | good |
| G | $SiO_2$ | 1.7 | 1.9 | 1.4 | 1.5 | good |
| H | $Cr_2O_3$ | 1.7 | 1.9 | 1.4 | 1.5 | good |
| Comparative Example 1 | — | 1.7 | 1.9 | 0.5 | 0.7 | poor |

What is claimed is:

1. A delivery member comprising a substrate material, a first coating film comprising of a resin containing a filler and formed by electrodeposition on the substrate material, and a second coating film composed of an organic coating film formed on the first coating film.

2. A delivery member according to claim 1, wherein the substrate material is made of a metal.

3. A delivery member according to claim 1, wherein the substrate material is made of a plastics.

4. A delivery member according to claim 1, wherein the substrate material has been subjected to subbing.

5. A delivery member according to claim 1, wherein the filler is selected from powdery ceramics, powdery metals, and metal-plated powdery materials.

6. A delivery member according to claim 1, wherein the first coating film has a thickness of from 5 to 30 $\mu$m.

7. A delivery member according to claim 1, wherein the second coating film has a thickness of from 5 to 30 $\mu$m.

8. An electrophotographic apparatus comprising a photosensitive member, an image-exposing means, a developing means for developing a latent image formed by the image-exposing means, a transferring means for transferring the developed image onto an image-receiving medium, and a delivery path for delivering the image-receiving medium, the delivery path being constructed of a delivery member which comprises a first coating film comprising of a resin containing a filler and formed by electrodeposition on a substrate material, and a second coating film composed of an organic coating film formed on the first coating film.

9. An electrophotographic apparatus according to claim 8, wherein the delivery member comprises a delivery guide in a plate shape.

10. An electrophotographic apparatus according to claim 8, wherein the delivery member comprises a delivery roller.

11. An electrophotographic apparatus according to claim 8, wherein the delivery member comprises a delivery belt.

12. A facsimile machine, employing the electrophotographic apparatus of claim 8 as a printer.

13. An ink-jet recording apparatus comprising a recording head for ejecting ink onto an image-receiving medium at a print position, and a roller for delivering an image-receiving medium to the print position, the roller comprising a first coating film comprising of a resin containing a filler and formed by electrodeposition on a substrate material, and a second coating film composed of an organic coating film formed on the first coating film.

* * * * *

UNITED STATES PATENT AND TRADEMARK OFFICE

CERTIFICATE OF CORRECTION

PATENT NO. : 6,067,439

DATED : May 23, 2000

INVENTOR(S): SUSUMU KADOKURA, ET AL.

It is certified that error appears in the above-identified patent and that said Letters Patent is hereby corrected as shown below:

COLUMN 2:

Line 14, "deliverying" should read --delivering--.

COLUMN 3:

Line 7, "deliverying" should read --delivering--.
Line 65, "constituted" should read --composed--.

COLUMN 4:

Line 52, "deliverying" should read --delivering--.

COLUMN 5:

Line 44, "erying" should read --ering--.

COLUMN 6:

Line 53, "illustrate s" should read --illustrates--.
Line 62, "of the" should be deleted.

COLUMN 7:

Line 20, "rollers." should read --roller.--.

UNITED STATES PATENT AND TRADEMARK OFFICE

CERTIFICATE OF CORRECTION

PATENT NO. : 6,067,439

DATED : May 23, 2000

INVENTOR(S): SUSUMU KADOKURA, ET AL.

It is certified that error appears in the above-identified patent and that said Letters Patent is hereby corrected as shown below:

COLUMN 8:

Line 5, "upstable" should read --unstable--.

COLUMN 10:

Line 18, "Further" should read --Further,--.

Signed and Sealed this

Third Day of April, 2001

*Attest:*

Nicholas P. Godici

NICHOLAS P. GODICI

*Attesting Officer*

*Acting Director of the United States Patent and Trademark Office*